United States Patent [19]

Simon

[11] Patent Number: 4,487,357

[45] Date of Patent: Dec. 11, 1984

[54] METHOD FOR FORMING WELL DRILL TUBING

[76] Inventor: Joseph A. Simon, 237 Lothrop, Grosse Pointe Farms, Mich. 48236

[21] Appl. No.: 381,334

[22] Filed: May 24, 1982

[51] Int. Cl.[3] ..... B21C 25/04; B21C 25/08; B21C 23/08; B21C 33/00

[52] U.S. Cl. ..... 228/173 F; 72/260; 72/256; 72/266; 72/377; 228/114; 228/176

[58] Field of Search ..... 72/264, 266, 267, 260, 72/377, 256; 29/DIG. 48; 228/155, 156, 112–114, 173, 176

[56] References Cited

U.S. PATENT DOCUMENTS

| | | | |
|---|---|---|---|
| 1,688,421 | 10/1928 | Holmes | 29/159.3 |
| 1,776,855 | 9/1930 | Holmes | 228/155 |
| 2,932,889 | 4/1960 | Kritscher | 72/392 |
| 2,942,728 | 6/1960 | Hilton | 72/260 |
| 3,269,002 | 8/1966 | Hollander et al. | 228/113 |
| 3,837,205 | 9/1974 | Simon | 72/260 |
| 3,886,649 | 6/1975 | Simon | 228/112 |
| 3,948,073 | 4/1976 | Lovell | 72/266 |
| 4,171,560 | 10/1979 | Garrett | 228/176 |
| 4,277,969 | 7/1981 | Simon | 72/266 |
| 4,292,831 | 10/1981 | Simon | 72/260 |
| 4,301,672 | 11/1981 | Simon | 72/266 |

FOREIGN PATENT DOCUMENTS

| | | | |
|---|---|---|---|
| 194763 | 3/1965 | Switzerland | 72/393 |

*Primary Examiner*—Lowell A. Larson
*Attorney, Agent, or Firm*—Cullen, Sloman, Cantor, Grauer, Scott and Rutherford

[57] ABSTRACT

Seamless well drill tubes are formed by extruding seamed tube blanks through a die throat by pushing the tube blank through the die throat with a pusher rod having a portion located internally of the tube and die throat. The pusher rod has a narrow lead portion so that as the lead end of the tube length is forced through the die throat, its material flows inwardly to form an inwardly thickened annulus and therefore, the remainder of the pusher rod is located within the die throat and blank so that the blank material flows into the desired wall thickness. Before the tube is completely pushed through the die throat, the pusher rod is removed and the second tube blank is inserted in end to end contact with the trailing end of the first blank. Thereafter, the pusher rod is reinserted into the tube of blanks and advanced so that the force of the pusher rod causes the second tube to push the first tube completely through the die throat while the lead end of the pusher rod is positioned within the die throat so as to form the inwardly thickened end portions on the trailing end of the first blank and the lead end of the second blank. Thereafter, the cycle is completed to successively produce drill tubes having inwardly thickened flange-like ends. These ends may be converted into outwardly extending flanges by forcing a punch into each end to flow the thickened end annulus radially outwardly.

2 Claims, 10 Drawing Figures

METHOD FOR FORMING WELL DRILL TUBING

BACKGROUND OF THE INVENTION

Well drill tubing commonly is formed of long tubes that are connected together end to end to form a string. A well drill is secured to the bottom tube and a power source is connected to the uppermost tube for rotating the string for drilling within a well. As the drill progressively moves downwardly into the ground, additional tubes are coupled to the upper end of the string. For removal of the drill or for clearing of the well or for testing, etc., the string of tubes is lifted upwardly out of the well and the individual tubes are uncoupled. Thereafter, they are reinserted into the well and coupled together one by one, as they descend and the cycle is repeated.

Commonly used well drill tubes are formed of relatively expensive seamless tubes made of steel alloys suitable for this function. A typical tube could be roughly 24 feet in length with an outside diameter of $3\frac{1}{2}$ to $4\frac{1}{2}$ inches and with opposite ends that are thickened into a flange-like shape.

The thickened or flanged opposite ends are usually formed in an upsetting machine which involves holding a tube end in a die and hammering the tube ends by successive machine blows into the die cavity to form the enlarged or flanged-like ends.

After the well drill tube is formed, it is conventional to weld to its opposite ends coupling parts, that is, a threaded male coupling part on one end with a threaded female coupling on the opposite end so that each tube may be threadedly engaged with successive tubes. Conventionally, friction welding or spin welding is utilized to weld the adjacent annular ends of each coupling to the thickened end of the tube. This procedure is still followed with the improved tubing of this invention.

Because the tubes are subjected to relatively high loads from the weight of other tubes suspended below them. and also receive heavy twisting forces or torque, they must be made of relatively thick material. Then the tubes should be heat treated to handle the stresses and to provide the necessary metallurgical characteristics. The hammering action of the upsetting equipment particularly requires a follow-up heat treatment.

The invention herein relates to an improved method for forming drill tubing which improves the metallurgical characteristics of the tube for improving its strength characteristics, while permitting the use of a less expensive starting material.

A method for forming tubes by an extrusion procedure is described by my two prior patents, No. 3,837,205 issued Sept. 24, 1974, and No. 3,886,649 issued June 3, 1975 for the purpose of forming automotive axles. However, the extrusion methods disclosed in such patents have been confined to relatively short length tubes. For example, the length of an automotive vehicle axle is no more than a few feet. Forming very long tubes has been regarded as not possible. Thus, the invention herein relates to forming very long tubes, such as on the other of about 24 feet or longer, using forming blanks that could be roughly 20 feet in length.

SUMMARY OF THE INVENTION

The invention herein relates to a method for forming well drill tubes utilizing seamed or welded tubes instead of the presently used seamless tubes. The method in general comprises extruding a seamed tube blank endwise through a narrow die throat by means of a pusher rod or punch which pushes the tube endwise. The punch includes a rod portion which is closely fitted within the tube and which extends through the die throat so that the tube blank is extruded through the space between the pusher rod and the die throat. The lead end of the pusher rod is a narrower diameter than the main body of a pusher rod. Thus, the narrow lead end portion of the pusher rod is located within the die throat at the same time as the lead end of the tube blank is extruded therethrough. This results in the material of the tube blank flowing inwardly around the lead end of the pusher rod to produce an inwardly thickened flange-like end portion on the extruded tube.

The pusher rod is advanced to push almost the completed tube blank through the die throat. However, before completing the extrusion, the operation is stopped and the pusher rod is removed. A second tube blank is inserted into the die in end to end contact with the first tube blank and then the pusher rod is reinserted to exert a force against the second tube blank. This, in turn, pushes the first tube blank completely through the die throat. The blank then continues advancing in the same manner as did the first tube blank. However, the narrow lead end of the pusher rod, which is located in the die throat during the time that the trailing end of the first tube blank and the lead end of the second tube blank are extruded therethrough, causes inwardly thickened flange-like end portions to be formed on each. The cycle is repeated to successively produce well drilled tubes.

Due to the extrusion effect, the seam of the relatively inexpensive tube blank, disappears and the end product appears to be a seamless tube of the desired wall thickness with an inwardly extending flange-like annulus on each of its ends.

The end portions may be further treated to expand the inwardly thickened annulus outwardly into either complete or partially completely outwardly extending flanges. This is accomplished by inserting a punch into each end and moving the punch endwise to force the inwardly directed annulus to flow outwardly.

After the tube is completed, it may then be conventionally spin welded or friction welded to the conventional male and female coupling parts.

An object of this invention is to provide very long dies, such as longer than about 20 feet with corresponding long pushers or punches for handling tube blanks made of seamed tubing that may be on the order of about 20 feet long. The internal diameter of such tube blanks are close to the required finished tube internal diameter so that the blank is supported from collapsing inwardly by the punch extending through it, and outwardly by the wall of the die, during the time the punch also pushes it through the die.

Since no upsetting procedure is followed and since the tube is extruded, heat treating is unnecessary. Likewise, the extrusion is performed cold, that is either at room temperature or slightly above, rather than fully heating the tube so that compensatory heat treating after production of the tube, is unnecessary.

One object of this invention is to produce a well drill tube which has metallurgical characteristics that are superior to presently used relatively expensive tubes because of the utilization of the extrusion process which produces a better, elongated, grain structure and metallurgical characteristics which increase the yield strengths, elongation strengths, ductility and the like. Although the resultant tubes are stronger and metallurgically superior to present relatively expensive seamless tubing, the material used to make it is much less expensive. The cost is probably less than half the cost of the seamless type tubing currently used.

Another object of the invention is to produce the thickened annular flange-like ends required on well drill tubing by an extrusion means rather than the presently used upsetting or hammering techniques to thereby eliminate the necessity of follow-up heat treatment, while producing a product which is equal to or better than the prior type upset formed tubing.

These and other objects and advantages of this invention will become apparent upon reading the following description, of which the attached drawings form a part.

DETAILED DESCRIPTION

Figure 1:
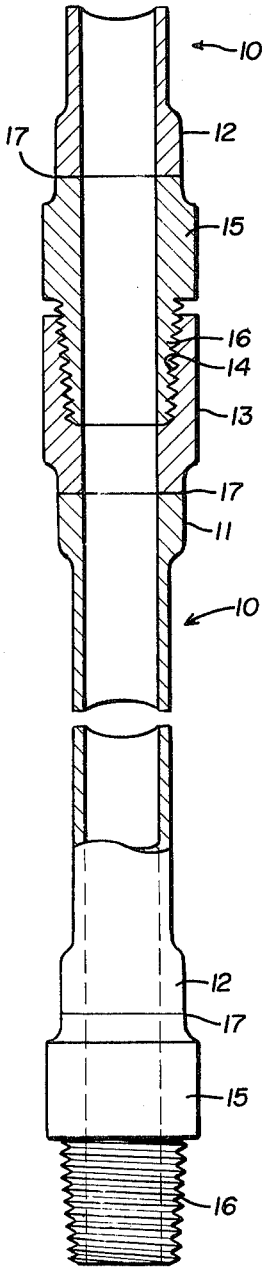
FIG. 1 is a partially cross-sectioned fragmentary view of one well drill tube coupled to another.

FIG. 1 shows a well drill tube 10 having a flanged or outwardly thickened upper end portion 11 and a similarly flanged or thickened lower end portion 12. A female coupling part 13, having an internally threaded socket 14 is secured to the upper end 11 of the tube. A corresponding male coupling part 15 having an external threaded portion 16 is fastened to the lower end of the tube.

The coupling parts are conventional elements which are friction welded at 17 to the adjacent end surfaces of the tube. The friction or spin welding is conventional for fastening such type of couplings upon the conventionally formed tubes.

The couplings are made so as to permit rapid coupling and uncoupling during the times that the well drill string of tubes is raised or lowered from the well. Thus, as shown in FIG. 1, another well drill tube 10 is coupled to the upper end of the first well drill tube.

The well drill tubes are long, such as 24 to 28 feet, approximately, and usually of a diameter of roughly $3\frac{1}{2}$ to $4\frac{1}{2}$ inches with a wall thickness of roughly $\frac{3}{8}$ of an inch. The dimensions may vary considerably, depending upon the nature and purpose of the tubing, but the above dimensions are illustrative of typical sizes utilized.

Figure 2:
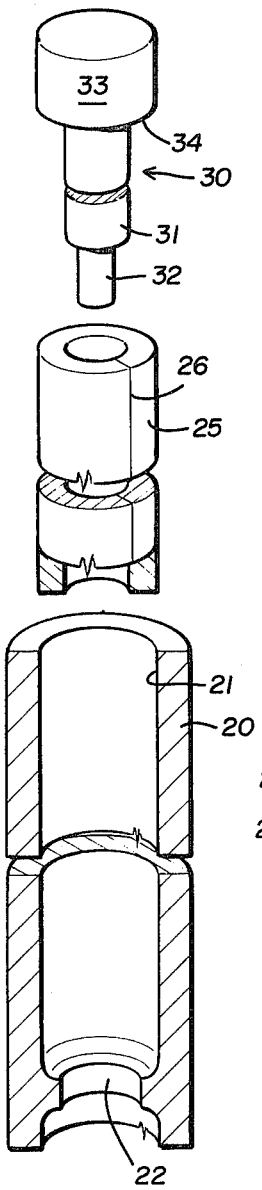
FIG. 2 is a perspective, partially fragmentary cross-sectional view of a die, tube blank, and pusher rod in axial alignment.

The method for forming the well drill tube includes providing a die 20 having a cylindrical cavity 21 and a constricted die throat 22 at its lower end. The die, which is schematically shown in FIG. 2, must be longer than the tube blank which will be used to form the well drill tube. Therefore, such a die may run as long as 20 feet or more.

A tube blank 25 is inserted within the die 20. This blank is formed of a tube which has a thicker wall and is shorter than the expected finished well drill tube, which will be extruded from it. The tube blank may be formd of conventional seamed tubing having a seam 26 (See FIG. 2).

The exact length and wall thickness of the tube will vary depending upon the finished size of the well drill tube. However, the tube blank has an internal diameter which is close to the expected finished internal diameter of the well drill tube.

A pusher rod or punch 30 is inserted within the tube blank. This rod is comprised of three sections. The first section is an elongated, cylindrical body portion 31 which is substantially of the same length as the blank and is of a diameter to closely fit within the internal opening in the blank. The second section is a narrow, lower or lead end portion 32 which has a narrower diameter than the body portion. The third section is a wider, upper portion 33 which forms a ram shoulder 34 for contacting against and pushing the upper end of the tube blank.

Figure 3:
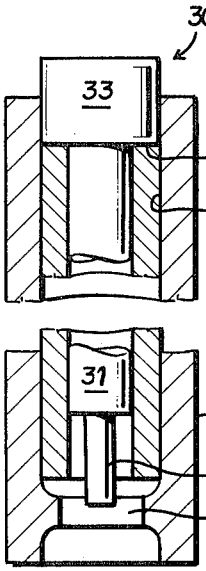
FIG. 3 is a fragmentary, cross-sectional, schematic view of a tube blank inserted within the die and with the pusher rod in position.

As shown in FIG. 3, the tube blank 25 is inserted in the cylindrical cavity 21 of the die 20. The pusher rod cylindrical body portion 31 is fitted within the tube blank and the ram shoulder 34 of the pusher rod engages the upper end of the blank.

Figure 4:
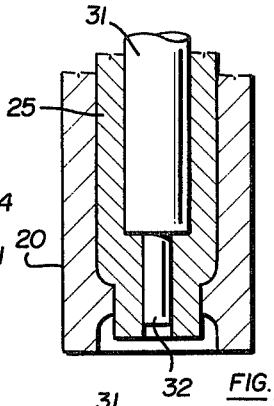
FIG. 4 is a schematic, fragmentary view of the lower end of the die, showing the beginnning of the extrusion of the tube blank.

The pusher rod is advanced axially through the die by means of a suitable pressure mechanism or ram, which is not shown. A conventional, large press may be used for this purpose. As the pusher rod advances, the lower end of the blank is extruded through the die throat, as illustrated in FIG. 4. The lower portion of the tube flows inwardly around the narrow, lead portion of the pusher rod.

Figure 5:
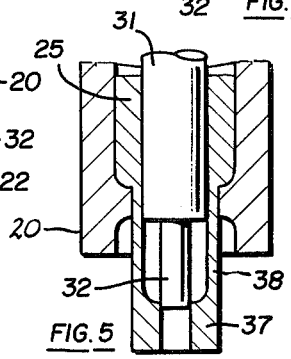
FIG. 5 is a view similar to FIG. 4, but showing the lower end of the tube blank formed, with the extrusion of the tube body proceeding.

Continued advancement of the pusher rod results in the pusher rod body portion 31 being aligned within the die throat, as contrasted with the lead portion having been aligned with the die throat previously. Thus, the flow of the blank metal is now around and against the main cylindrical body portion of the pusher rod to form the thinner wall of the tube. Previously, a lower, inwardly thickened flange-like end 37 was formed when the pusher rod lead end portion 32 was within the die throat. Thereafter, the main tube wall 38 is formed as shown in FIG. 5.

Figure 6:
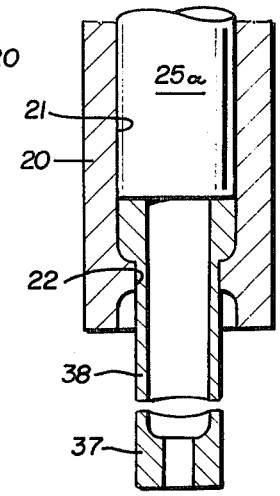
FIG. 6 is a view showing the stopping of the extrusion of the tube blank and the insertion of a second tube blank into the die.
Figure 7:
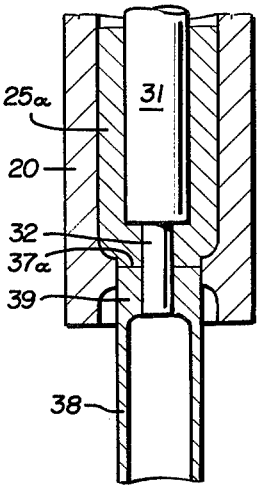
FIG. 7 is a view similar to FIG. 6, but showing the extrusion of the upper end of the first blank and the beginning of the extrusion of the second blank.
Figure 8:
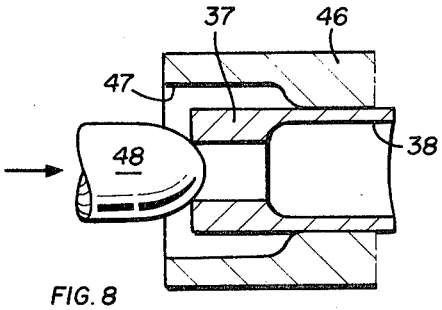
FIG. 8 is an enlarged, cross-sectional schematic view showing the step of forcing the inwardly thickened end portion to flow outwardly by means of a punch and die.

The advancement of the pusher rod continues until the blank is almost completely through the die throat. At that point, the pusher rod is stopped and removed from the die completely. Then, as shown in FIG. 6, a second blank **25*a* is inserted in the die. The pusher rod is reinserted in the die, in the second tube blank, as shown in FIG. 7**, and is advanced again.

The further advancement of the pusher blank moves the upper, second blank against the lower blank which is thereupon pushed through the die throat. At this point, the narrow lead end portion 32 of the pusher rod is aligned within the die throat so that an inwardy thickened end portion 39 is formed on the upper end of the first blank. Simultaneously, the thickened flange-like end portion 37*a* is formed on the lower end of the second blank.

The process is continued, blank by blank, so that each blank pushes the preceding blank through the die throat in the manner described above.

Figure 9:
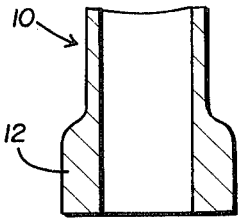
FIG. 9 is a cross-sectional view of the end of a weld tube showing an outwardly extending, flange-like thickened portion.

The completed tubes each have inwardly thickened, flange-like end portions which are of sufficient annular width to accomodate the male and female coupling parts that are welded to them. However, in typical well drill tubing, the flange-like thickening is located on the outside of the tube wall, rather than on the inside. Hence, the flange-like end portions are moved outwardly, by inserting one end of a tube within a flanging die 46 having a cavity 47 surrounding the lower end of the tube. An expanding ram 48 is inserted and forced longitudinally into the tube end to cause the thicker portion to flow outwardly into the cavity to produce the outwardly extending flange 12 illustrated in FIG. 9.

Figure 10:
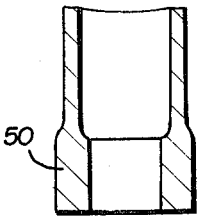
FIG. 10 is a view similar to FIG. 9, but showing a modified form of thickened end which partially extends inwardly and partially extends outwardly.

For some types of tubing, flanges which partially extend inwardly and outwardly can be provided as shown in FIG. 10. This can be accomplished by using an expanding ram 48 of a diameter slightly less than the internal diameter of the tube.

The type of end thickening illustrated in FIG. 10 is useful where machining is to be performed on the inside end wall of the tube. Thus, stock is provided for machining purposes, with the thickened end 50 shown in FIG. 10.

The extrusion of such an elongated tube length through a die is accomplished by utilizing a die of a length greater than the tube, such as 20 feet or more in length and an internal pusher rod or punch portion that fills the internal opening in the blank. Normally, pushing on the end of a tube of that length, with a relatively thin wall, would cause the tube to buckle rather than extrude from a die throat. Thus, the concept of extruding a tube length of such size is believed to be contrary to expected extrusion practices. Here the product is formed without buckling or inward flexing.

Having fully described an operative embodiment of this invention, I now claim:

1. A method for forming a seamless, flanged end, drill pipe tube from seamed tube blanks comprising:

providing a straight, substantially uniformed diameter and uniform wall thickness tube blank that is considerably shorter in length and has a greater wall thickness than the desired drill pipe tube;

positioning the tube blank endwise within an elongated, cylindrically shaped die opening having a small diameter restricted die throat portion at its lead end for receiving the lead end of the tube blank, and wherein the tube blank is formed of a seamed tube material and said seam being eliminated during the extrusion of the tube blank through the die throat to form seamless drill tubing;

inserting an elongated pusher rod into the tube blank opposite end, with the pusher rod having a substantially uniform diameter of approximately the desired internal diameter of the drill tube, except for its lead end portion being of a smaller diameter and being located at the lead end of the tube blank, and having a trailing end located outwardly of the trailing end of the tube blank and formed with a shoulder portion for applying a longitudinally directed pushing force upon the trailing end of the tube blank to force it in an axial direction;

advancing the pusher rod longitudinally so that its shoulder portion extrudes the tube blank through the die throat;

positioning the pusher rod lead end portion within the die throat during the time that the pusher rod advances and causes the tube blank lead end portion to pass through the die throat for flowing the material comprising the lead end portion of the tube length radially inwardly into an inwardly thickened annulus;

positioning the remainder of the pusher rod within the die throat portion during further advancement of the pusher rod for flowing the body of the tube length around the pusher rod to form the internal wall of the drill tube while the die throat forms the external wall of the drill tube;

stopping the advance of the pusher rod just before the trailing end portion of the tube length is pushed through the die throat;

removing the pusher rod from the tube length and from the die and inserting a second tube blank with its lead end abutting the trailing end of the first tube blank;

reinserting the pusher rod into the tube blank and advancing the pusher rod to exert a longitudinally directed force upon the second tube blank so that it pushes the first tube blank through the die throat;

positioning the pusher rod lead end portion within the die throat while the trailing end of the first tube blank and the lead end of the second tube blank passed through the die throat for forming an inwardly thickened annulus on each blank during the endwise advancement of the pusher rod;

after the first tube blank is extruded through the die throat, continuing the cycle of pushing the second tube blank and thereafter removing the pusher rod and adding the next tube blank to successively form drill tubes;

wherein elongated drill tubes are formed, each having a wall thickness corresponding to the space between the die throat defining wall and the outer wall surface of the pusher rod and each having inwardly thickened flange-like ends; and including inserting a punch endwise into the opposite ends of the completed drill tube and axially moving the punch endwise of the tube to force the thickened annulus at each end radially outwardly a sufficient distance to form outwardly extending flange-like end portins due to the material flow; and welding male and female coupling parts to the opposite flange-like end portions.

2. A method as defined in claim 1, and including forming the thickened annular end portions on the tube radially outwardly, by means of endwise forcing an enlarged punch into first one end and then the opposite end of the drill tube to cause the thickened annulus to flow outwardly a sufficient distance to extend at least partially beyond the outer wall surface defining the tube and partially inwardly of the inner wall surface defining the tube wall.

* * * * *